US006680574B1

(12) United States Patent
Gaertner et al.

(10) Patent No.: US 6,680,574 B1
(45) Date of Patent: Jan. 20, 2004

(54) GAS DISCHARGE LAMP COMPRISING AN OXIDE EMITTER ELECTRODE

(75) Inventors: Georg Gaertner, Aachen (DE); Wim Van Den Hoek, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 371 days.

(21) Appl. No.: 09/718,252

(22) Filed: Nov. 22, 2000

(30) Foreign Application Priority Data

Nov. 29, 1999 (DE) ..... 199 57 420

(51) Int. Cl.[7] ..... H01J 17/04; H01J 61/04
(52) U.S. Cl. ..... 313/633; 313/575; 313/491
(58) Field of Search ..... 313/633, 491, 313/575, 352, 309, 336, 351, 495

(56) References Cited

U.S. PATENT DOCUMENTS 3,582,702 A * 6/1971 Almer ..... 313/558
4,303,848 A * 12/1981 Shimizu et al. ..... 313/346 R
5,585,694 A * 12/1996 Goldburt et al. ..... 313/491
5,847,498 A * 12/1998 Mehrotra et al. ..... 313/352
6,054,802 A * 4/2000 Ohira et al. ..... 313/326

FOREIGN PATENT DOCUMENTS

DE 1021482 4/1957 ..... H01J/82/02

* cited by examiner

*Primary Examiner*—Edward J. Glick
*Assistant Examiner*—Elizabeth Gemmell

(57) ABSTRACT

A gas discharge lamp comprising an electrode including a carrier of an electrode metal, selected from the group formed by tungsten and tungsten-containing alloys, and a first coating of a first electron-emitting material, which material comprises an alkaline earth metal oxide, selected from the group formed by calcium oxide, strontium oxide and barium oxide, and a rare earth metal oxide, selected from the group formed by scandium oxide, yttrium oxide and europium oxide, in a quantity a that ranges from 0.1 to 10 wt. % by weight, is characterized by a longer service life, a higher resistance to poisoning and a robust manner of coping with a rapid succession of switching operations, as well as a short ignition stage.

3 Claims, 1 Drawing Sheet

GAS DISCHARGE LAMP COMPRISING AN OXIDE EMITTER ELECTRODE

FIELD OF THE INVENTION

The invention relates to a gas discharge lamp, in particular a low-pressure gas discharge lamp, which comprises an electrode including a carrier and a coating of an electron-emitting material, which material comprises an alkaline earth metal oxide, which is selected from the group formed by calcium oxide, strontium oxide and barium oxide, and an oxide of a rare earth metal.

BACKGROUND OF THE INVENTION

The generation of light in a gas discharge lamp is based on the ionization, and the resulting electric discharge, of the atoms of the filling gas in the lamp when an electric current flows through the lamp. The electrodes of the lamp emit electrons, which are so strongly accelerated by the electric field between the electrodes that, upon colliding with the gas atoms, they are capable of exciting and ionizing the latter. When the gas atoms return to the ground state, and also in the case of the recombination of electrons and ions, a more or less substantial part of the potential energy is converted to radiation.

The number of electrons that can be emitted by the electrodes depends upon the work function of the electrodes for electrons. Tungsten, which is customarily used as the electrode metal, has a comparatively high work function. For this reason, the electrode metal is customarily coated with a material which serves to improve the electron-emitting properties of the electrode metal. It is typical of the electron-emitting coating materials of electrodes in gas discharge lamps that they contain an alkaline earth metal, either in the form of the alkaline earth metal oxide or in the form of an alkaline earth metal-containing starting compound (precursor) for the alkaline earth metal oxide.

Thus, conventional low-pressure gas discharge lamps are generally provided with electrodes which are composed of tungsten wires with an electron-emitting coating containing oxides of the alkaline earth metals calcium, strontium and barium.

To manufacture such an electrode, a tungsten wire is coated, for example, with the carbonates of the alkaline earth metals in a binder preparation. During evacuating and baking out the lamp, the carbonates are converted into the oxides at temperatures of approximately 1000° C. After this "burn-off" of the electrode, the electrode already supplies a noticeable emission current which, however, is not stable yet. Next, an activation process is carried out. Due to this activation process, the originally non-conducting ion lattice of the alkaline earth oxides is converted to an electronic semiconductor. In this process, donor-type imperfections are incorporated into the crystal lattice of the oxides. These lattice imperfections essentially consist of elementary alkaline earth metal, for example calcium, strontium or barium. The electron emission of such electrodes is based on this mechanism of lattice imperfections. The activation process serves to provide a sufficient quantity of excess, elementary alkaline earth metal, enabling the oxides in the electron-emitting coating to supply as much emission current as possible at a prescribed heating capacity.

As regards the function of these electrodes and the service life of the lamp, it is important that elementary alkaline earth metal is constantly available. The reason for this being that the electrode coating continuously loses alkaline earth metal during the service life of the lamp, which is partly caused by the fact that the electrode coating evaporates slowly, and partly by the fact that the electrode coating is sputtered off by the ionic current in the lamp.

The elementary alkaline earth metal is initially dispensed continuously by a reduction of the alkaline earth oxide at the tungsten wire during operation of the lamp. However, this dispensation stops when the tungsten wire is passivated, in the course of time, by a highly resistive interface of tungsten oxide, alkaline earth silicate or alkaline earth tungstate.

DE 1 021 482 discloses a method of manufacturing an oxide cathode for low-pressure discharge lamps, the activating substance of which is composed of a mixture of barium oxide, strontium oxide and calcium oxide, which are formed during the activation of the cathode by thermal decomposition of the alkaline earth carbonates used as the starting material, an inactive additive composed of at least one oxide of the elements: titanium, germanium, aluminum and other elements of group III of the periodic system, particularly the rare earth elements, being added to the alkaline earth-carbonate mixture in such a quantity that the overall quantity of the added oxides in the completely activated cathode does not exceed the smallest quantity of alkaline earth oxide used, and the cathode is activated by heating to a temperature below 1,000° C., preferably 800° C. to 900° C. This method has the advantage that the carbonates are rapidly decomposed at low temperatures and the lamp does not contain carbonic acid.

SUMMARY OF THE INVENTION

It is an object of the present invention to provide a gas discharge lamp with an extended service life and an improved emission current.

In accordance with the invention, this object is achieved by a gas discharge lamp comprising an electrode including a carrier of an electrode metal, selected from the group formed by tungsten and tungsten-containing alloys, and a first coating of a first electron-emitting material, which material comprises an alkaline earth metal oxide, selected from the group formed by calcium oxide, strontium oxide and barium oxide, and a rare earth metal oxide selected from the group formed by scandium oxide, yttrium oxide and europium oxide in a quantity that ranges from 0.1 to 10 wt. % by weight.

In such a gas discharge lamp the passivation of the electrode metal is reduced, so that alkaline earth metal is released from the oxide over a longer period of time and the work function of the electrode remains low. This results in a shorter ignition stage of the lamp. At the same time, the addition of a rare earth metal oxide, in a quantity "A" that ranges from 0.1 to 10 wt. % by weight, brings about a reduction of the evaporation of elementary alkaline earth metal and hence leads to a longer service life. The electrode has a high initial emission and contains sufficient elementary alkaline earth metal throughout the service life of the lamp. The availability of sufficient elementary alkaline earth metal also leads to a high resistance to poisoning by oxygen.

These advantageous effects are enhanced if a second coating of a second electron-emitting material is arranged between the carrier and the first coating, said second electron-emitting material comprising an alkaline earth metal oxide, selected from the group formed by calcium oxide, strontium oxide and barium oxide, and a rare earth metal oxide, selected from the group formed by scandium oxide, yttrium oxide and europium oxide, in a quantity "B" that ranges from 2.0 to 20% by weight.

Particularly advantageous effects are achieved when quantity a<quantity b.

It may also be preferred to provide a third coating between the carrier and the first coating, which third coating is composed of a noble metal selected from the group formed by rhenium, cobalt, nickel, ruthenium, palladium, rhodium, iridium, platinum. Such a gas discharge lamp has a reduced ignition stage, and the electrode accommodated in such a lamp has an improved conductivity.

It may further be preferred that the first electron-emitting material comprises zirconium oxide. It may also be preferred that the second electron-emitting material comprises zirconium oxide.

It may additionally be preferred that the first electron-emitting material comprises a metal powder preparation of a metal selected from the group formed by aluminum, silicon, titanium, zirconium, hafnium, tantalum, molybdenum, tungsten and the alloys thereof, which metal powder preparation is provided with a powder coating of a noble metal selected from the group formed by rhenium, cobalt, nickel, ruthenium, palladium, rhodium, iridium and platinum.

These and other aspects of the invention will be apparent from and elucidated with reference to a single drawing and four embodiments that are described hereinafter.

DETAILED DESCRIPTION OF THE INVENTION

Figure 1:
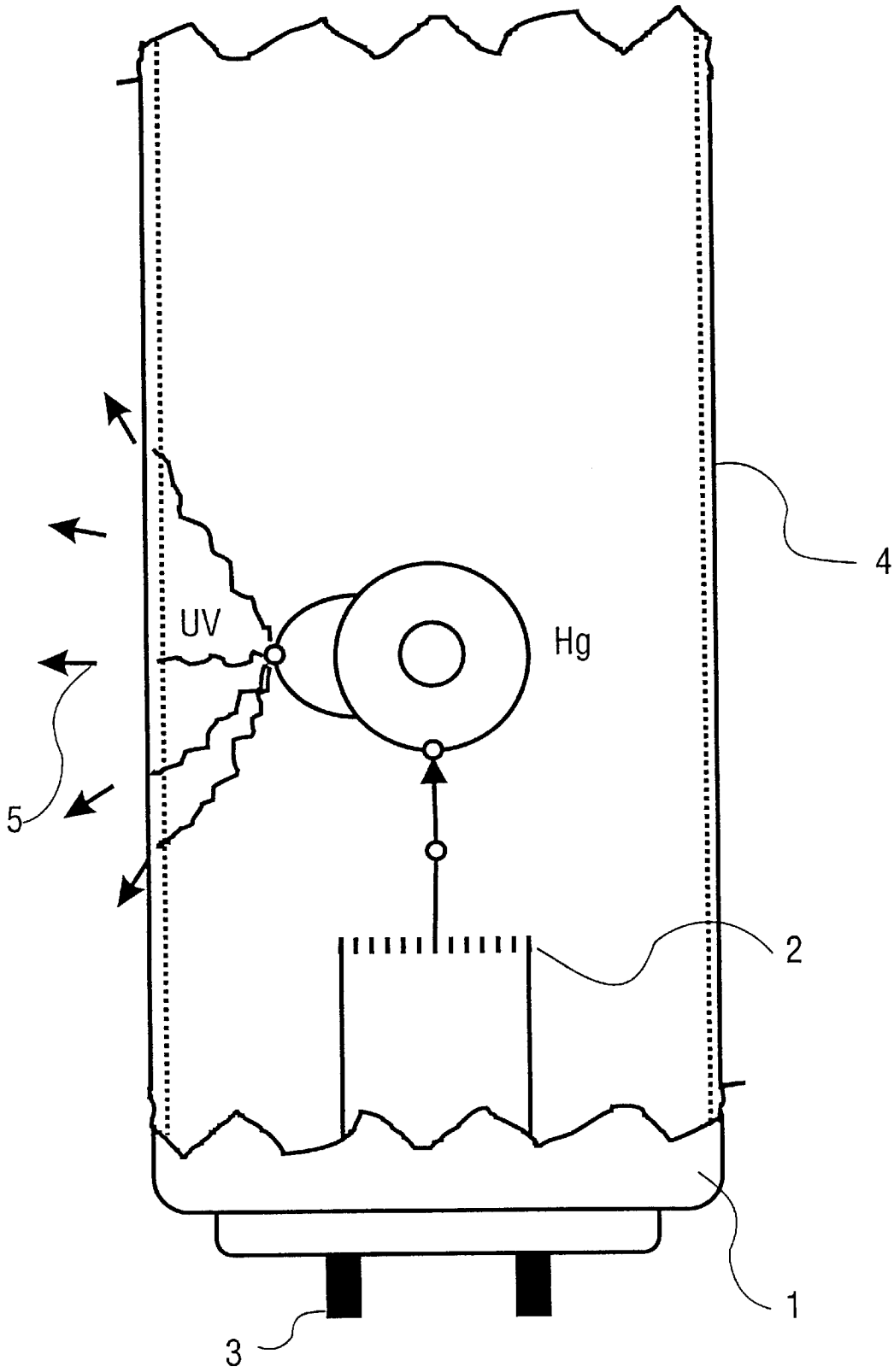
FIG. 1 diagrammatically shows the generation of light in a fluorescent lamp.

Gas discharge lamps can be divided into low-pressure lamps and high-pressure lamps. They differ in the way in which they stabilize the discharge. FIG. 1 shows, by way of example, a low-pressure discharge lamp with a mercury filling, i.e. a fluorescent lamp. Such a gas discharge lamp is composed of a rod, ring or U-shaped glass tube 1. At the ends of the tube there are electrodes 2. For the connection use is made of dual-pin caps 3. The inner surface of the glass tube is provided with a phosphor layer 4, the chemical composition of which determines the spectrum of the light or its chrominance. Apart from an inert gas filling of argon, the glass tube contains a small quantity of mercury or mercury vapor which, when rendered luminescent under operating conditions, emits the Hg resonant line at a wavelength of 253.7 nm in the ultraviolet range. The UV radiation emitted excites the phosphors in the phosphor layer, thereby causing them to emit light in the visible range 5.

The lamp also comprises means for igniting and for operating, for example a fluorescent lamp ballast and a starter.

A gas discharge lamp in accordance with the invention comprises an electron-emitting electrode, which includes a carrier of an electrode metal and a first coating containing an electron-emitting material.

The carrier of an electrode metal is customarily made of tungsten or a tungsten alloy, possibly with a molybdenum core. The carrier may be in the form of a wire, a coil, a spiral, an undulated wire, a tube, a ring, a plate or a tape. The carrier is customarily heated directly by the current flow.

In accordance with an embodiment of the invention, the carrier of an electrode metal may be additionally provided with a coating of a noble metal selected from the group formed by rhenium, cobalt, nickel, ruthenium, palladium, rhodium, iridium, platinum. Preferably, the coating is a 0.1 to 2 $\mu$m thick iridium or rhenium layer.

The raw material for the electron-emitting substance of a first coating is applied to this carrier. To prepare the raw material for this coating, the carbonates of the alkaline earth metals selected from the group formed by calcium, strontium and barium are mixed with a quantity a of a rare earth metal oxide that ranges from 0.1 to 10% by weight, said rare earth metal oxide being selected from the group formed by scandium oxide, yttrium oxide and europium oxide. The weight ratio of calcium carbonate:strontium carbonate:barium carbonate typically is 1:1.25:6 or 1:12:22 or 1:1.5:2.5 or 1:4:6.

Alternatively, the mixture of alkaline earth oxides and rare earth metal oxide can be prepared by coprecipitation, in that a water-soluble compound of the rare earth metals is added to a solution of the alkaline earth nitrates, whereafter the alkaline earth carbonates and the rare earth metal oxides are precipitated by the addition of sodium carbonate.

The electron-emitting material may comprise further components, for example zirconium oxide.

In addition, a metal powder of the metals of the group formed by aluminum, silicon, titanium, zirconium, hafnium, tantalum, molybdenum, tungsten, and their alloys with a metal of the group formed by rhenium, rhodium, palladium, iridium and platinum having a powder coating of iridium, rhenium, rhodium, platinum, palladium, nickel and cobalt can be added to the electron-emitting material. Preferably, a metal powder having an average grain size of 2 to 3 $\mu$m with a 0.1 to 0.2 $\mu$m thick powder coating is used. For the powder coating method use can be made of CVD methods, such as fluid-bed CVD. This coated metal powder is added to the raw material.

The raw material may additionally be mixed with a binder. Subsequently, the raw material is applied to the carrier by means of brushing, dip coating, cataphoretic deposition or spraying.

A second electrode coating of a second electron-emitting material may be arranged between the carrier and the first electrode coating, said second electron-emitting material comprising an alkaline earth metal oxide, selected from the group formed by calcium oxide, strontium oxide and barium oxide, and a rare earth metal oxide, selected from the group formed by scandium oxide, yttrium oxide and europium oxide, in a quantity b that ranges from 2.0 to 20% by weight.

Also the second electron-emitting material may additionally contain zirconium oxide or a metal powder of the metals selected from the group formed by aluminum, silicon, titanium, zirconium, hafnium, tantalum, molybdenum, tungsten and their alloys with a metal selected from the group formed by rhenium, palladium, rhodium, iridium and platinum, which is provided with a powder coating of iridium, rhenium, rhodium, platinum, palladium, nickel and cobalt.

The coated electrodes are sealed in the end portions of the lamp. The electrodes are activated during evacuating and filling the lamp. The electrode wire is heated to a temperature in the range from 1000° C. to 1200° C. by direct passage of current. At this temperature, the alkaline earth carbonates are converted, while releasing CO and $CO_2$, to alkaline earth oxides, and then form a porous sintered body. After this "burn-off" of the electrodes, a second activation process is carried out, which serves to supply excess elementary barium intercalated into the oxides. Said excess barium is formed by the reduction of barium oxide. In the actual reduction activation process, barium oxide is reduced by the released CO or by the carrier metal. In addition, a current activation process is carried out which enables the required free barium to be formed by electrolytic processes at high temperatures.

During operation of the lamp, the oxides evaporate slowly as a result of the ion bombardment in the focal point.

EXAMPLE 1

A triple-coiled tungsten wire is coated with iridium in a layer thickness of 1.0 $\mu$m. For the electron-emitting coating, 3 wt. % scandium-oxide powder having an average grain size of 2 $\mu$m and 3 wt. % zirconium metal are added to a triple carbonate mixture composed of $BaCO_3$:$SrCO_3$:$CaCO_3$ in a ratio of 1.6:1.25:1, whereafter they are mixed and processed with butyl acetate and cellulose nitrate. This suspension is brushed onto the coated tungsten wire, whereafter said wire is introduced into a lamp bulb and heated to 1000° C.

When the electrode is being baked out, the carbonates of the alkaline earth metals convert to their oxides and the zirconium metal converts to zirconium oxide. Following this burn-in process, an activation process may be carried out.

Such a lamp has a long service life, a short ignition stage, a low work function of 1.42 eV and a conductivity which is improved by a factor of 2.

EXAMPLE 2

A quantity of 5 wt. % scandium oxide is admixed with a triple carbonate composed of $BaCO_3$:$SrCO_3$:$CaCO_3$ in a ratio of 22:12:1, whereafter the mixture is suspended with butyl acetate and cellulose nitrate and brushed onto a double-coiled tungsten wire, whereafter said wire is introduced into a lamp bulb and heated to 1000° C. Following this bum-in process, an activation process may be carried out.

EXAMPLE 3

A quantity of 3 wt. % yttrium oxide powder having an average grain diameter of 2.5 $\mu$m is admixed with a triple carbonate composed of $BaCO_3$:$SrCO_3$:$CaCO_3$ in a ratio of 2.5:1.5:1, whereafter the mixture is suspended with butyl acetate and cellulose nitrate and brushed onto a double-coiled tungsten wire, whereafter said wire is introduced into a lamp bulb and heated to 1000° C. Following this burn-in process, an activation process may be carried out. Such a lamp is characterized by a longer service life and a higher resistance to poisoning.

EXAMPLE 4

An electron-emitting substance is prepared from a triple carbonate composed of $BaCO_3$:$SrCO_3$:$CaCO_3$ in a ratio of 6:4:1, which is admixed with 0.02 wt. % europium oxide powder by coprecipitation, and from a further 3 wt. % europium oxide having an average grain diameter of 4.0 $\mu$m. The mixture is suspended with butyl acetate and cellulose nitrate and brushed onto a triple-coiled tungsten wire, whereafter said wire is introduced into a lamp bulb and heated to 1000° C. Following this burn-in process, an activation process may be carried out. Such a lamp is characterized by a longer service life, a higher resistance to poisoning and a robust manner of coping with a rapid succession of switching operations.

What is claimed is:

1. A gas discharge lamp comprising an electrode including a carrier of an electrode metal, selected from a group consisting of tungsten and tungsten-containing alloys, and a first coating of a first electron-emitting material, the first material comprising one of both a rare earth oxide and an alkaline earth metal oxide, said alkaline earth metal oxide selected from the group consisting of calcium oxide, strontium oxide and barium oxide, and the rare earth metal oxide, selected from a group consisting of scandium oxide, and europium oxide, wherein the rare earth metal oxide is in a quantity "A" that ranges from 0.1 to 10% by weight;

the gas discharge lamp further comprising a second coating of a second electron-emitting material arranged between the carrier and the first coating, wherein said second material comprises one of both said rare earth oxide and said alkaline earth metal oxide, wherein the rare earth metal oxide is in a quantity "B" that ranges from 2.0 to 20% by weight.

2. A gas discharge lamp as claimed in claim 1, wherein quantity "A"<quantity "B".

3. A gas discharge lamp comprising an electrode including a carrier of an electrode metal, selected from a group consisting of tungsten and tungsten-containing alloys, and a first coating of a first electron-emitting material, the first material comprising one of both a rare earth oxide and an alkaline earth metal oxide, said alkaline earth metal oxide selected from the group consisting of calcium oxide, strontium oxide, and barium oxide, and the rare earth metal oxide, selected from a group consisting of scandium oxide and europium oxide, wherein the rare earth metal oxide is in a quantity "A" that ranges from 0.1 to 10% by weight;

the gas discharge lamp further comprising a second coating of a second electron emitting material arranged between the carrier and the first coating, wherein said second material comprises one of both said rare earth oxide and said alkaline earth metal oxide, wherein the rare earth metal oxide is in a quantity "B" that ranges from 2.0 to 20% by weight, and wherein the second coating further comprises zirconium oxide.

* * * * *